US009092922B2

(12) United States Patent
Mugica et al.

(10) Patent No.: US 9,092,922 B2
(45) Date of Patent: Jul. 28, 2015

(54) SYSTEMS, METHODS, AND PROGRAMS FOR VOTER INFORMATION INITIALIZATION AND CONSOLIDATION

(75) Inventors: Antonio Mugica, Caracas (VE); Eduardo Correia, Caracas (VE); Roger Pinate, Caracas (VE)

(73) Assignee: SMARTMATIC INTERNATIONAL CORPORATION, St. Michael (BB)

( * ) Notice: Subject to any disclaimer, the term of this patent is extended or adjusted under 35 U.S.C. 154(b) by 1779 days.

(21) Appl. No.: 12/000,411

(22) Filed: Dec. 12, 2007

(65) Prior Publication Data

US 2009/0152350 A1 Jun. 18, 2009

(51) Int. Cl.
*G07C 13/00* (2006.01)

(52) U.S. Cl.
CPC ..... *G07C 13/00* (2013.01)

(58) Field of Classification Search
USPC ..... 235/386; 705/11, 12
See application file for complete search history.

(56) References Cited

U.S. PATENT DOCUMENTS 4,641,240 A * 2/1987 Boram ..... 705/12
2002/0072962 A1* 6/2002 Weiss ..... 705/12
2003/0195798 A1* 10/2003 Goci ..... 705/11
2005/0021479 A1* 1/2005 Jorba et al. ..... 705/67
2008/0093449 A1* 4/2008 Cummings ..... 235/386
2009/0032591 A1* 2/2009 Cordery et al. ..... 235/386

OTHER PUBLICATIONS

Internet article, "File formats that are supported in Excel" retrieved on Nov. 10, 2014 from Microsoft.com website at http://office.microsoft.com/en-us/excel-help/file-formats-that-are-supported-in-excel-HP010014103.aspx reference to formats that were supported in the 2007 version of Microsoft Excel.*

* cited by examiner

*Primary Examiner* — Daniel Hess
(74) *Attorney, Agent, or Firm* — Oliff PLC

(57) ABSTRACT

Systems, methods, and programs allow for the secure compilation of vote data from electronic voting machines at a voting location. Systems, methods, and programs provide the secure electronic transmission of the vote data to a central location for tabulation. provide a vote data consolidation function that can collect and consolidate vote data from a plurality of types or generations voting machines. Systems, methods, and programs provide a vote data transmission function that can communicate with a server in a central tabulation headquarters to securely transmit vote data that has been consolidated from a plurality of voting machines. Systems, methods, and programs provide a voter initialization function, wherein, after establishing a voter's identity, a voter authorization card may be initialized for the voter to gain access to a voting machine.

45 Claims, 6 Drawing Sheets

SYSTEMS, METHODS, AND PROGRAMS FOR VOTER INFORMATION INITIALIZATION AND CONSOLIDATION

BACKGROUND

1. Related Technical Fields

Related technical fields include electronic voting machines, and in particular, electronic voting machines that initialize, consolidate, and/or transmit voter and/or vote information to a central facility for tabulation.

2. Related Art

Electronic voting machines are increasingly used in elections at a world level, particularly, direct-recording electronic (DRE) voting machines. DRE voting machines record votes by means of a ballot display provided with mechanical or electro-optical components that can be activated by the voter. A DRE voting machine, interacting with the voter, receives, accepts and processes vote data by means of a computer program, and records votes in a memory.

In 1998 the Federal Election Commission issued performance and test standards for DRE systems. The 1990 FEC Standards encompass DRE voting systems that record votes by means of a ballot display provided with mechanical or electro-optical devices that can be actuated by the voter, that process the data by means of a computer program, and that record voting data and ballot images in memory devices, such as, for example, data cartridges, internal memories, or external memories. The disclosed DRE produces a tabulation of the voting data as a hard copy or stored in a removable memory device.

Further, in conventional DRE voting systems it is often necessary to remove a memory device from the DRE machine and physically transport the memory devices to a central location for tabulation, which requires that the memory devices are collected by personnel, identified, marked, packed, and subject to manual control.

In many instances in a given election, a State or a County makes use of their existing inventory of voting equipment, which can include machines of various types, from different vendors, and having disparate technological levels. In fact, varied voting machines are employed concurrently, even in the same precinct. Optical Scanning voting machines usually produce cartridges where precinct counts are stored, and likewise, said cartridges need to be collected and physically taken to a tallying facility in order to be processed.

SUMMARY

However, there are concerns with respect to the integrity of electronic voting data. In particular, electronic data may be subject to tampering during the time needed to physically transport the memory devices from remote locations to a central tabulating location, potentially leaving no evidence of the tampering. As a result, there is a need to ensure the integrity of the results of electronic voting, thus ensuring that only the valid data and all the valid data as stored in each and every voting machine is brought securely, reliably and timely to a central tallying headquarters.

Because conventional DRE voting systems require the memory devices are subject to such manual controls, there is great concern with respect to the integrity of the data. For example, there exists a risk of damage, loss, misidentification, delay, or other mistakes occurring before the vote data stored therein can be tabulated.

Furthermore, there is no standard with respect to the software or type of memory devices used in various DRE voting systems. Accordingly, it may be difficult to utilize DRE machines for an election, particularly when the election may utilize more than one type of DRE machine, or different generations of DRE machines from the same vendor, or even DRE machines from different vendors. Using different voting machines may cause difficulties in smoothly initializing voter data, consolidating the recorded vote data from the various voting machines at a particular voting location, and/or consolidating the vote data from various voting locations at a central headquarters.

Accordingly, various exemplary implementations of the broad principles described herein provide systems, methods, and programs, that allow for the secure compilation of vote data from electronic voting machines at a voting location and the secure electronic transmission of the vote data to a central location for tabulation.

Various exemplary implementations provide a vote data consolidation function that can collect and consolidate vote data from a plurality of types or generations voting machines.

Various exemplary implementations provide a vote data transmission function that can communicate with a server in a central tabulation headquarters to securely transmit vote data that has been consolidated from a plurality of voting machines.

Various exemplary implementations may also provide an enhanced vote data transmission function in order to receive partial vote data transmitted from other locations having a plurality of voting machines each; and after such vote data has been consolidated, to transmit the consolidated vote data to a central tabulation headquarters.

Various exemplary implementations provide a voter initialization function, wherein, after establishing a voter's identity, a voter authorization card may be initialized for the voter. After the authorization card is initialized, the voter may use the card to gain access to a voting machine.

Finally, various exemplary implementations provide enhanced security by implementing systems, methods, and programs that manage an password-based authorization mechanism. Such security mechanism would operate at the voter initialization and at the vote consolidation levels. In each case, an input password is compared with the stored authorization password, and if the input password equals the stored password, the result will be that the intended function will be allowed: either a voter card that uniquely identifies a corresponding voter will be initialized, the voter card subsequently allowing access to a voting machine; or a data structure of the input vote data will be recognized, and based on the data structure of the vote data, the vote count data from the input vote data will be extracted, and the vote count data will be added to the vote tally data.

BRIEF DESCRIPTION OF THE DRAWINGS

Exemplary implementations will now be described with reference to the accompanying drawings, wherein.

DETAILED DESCRIPTION OF EXEMPLARY IMPLEMENTATIONS

Figure 1:
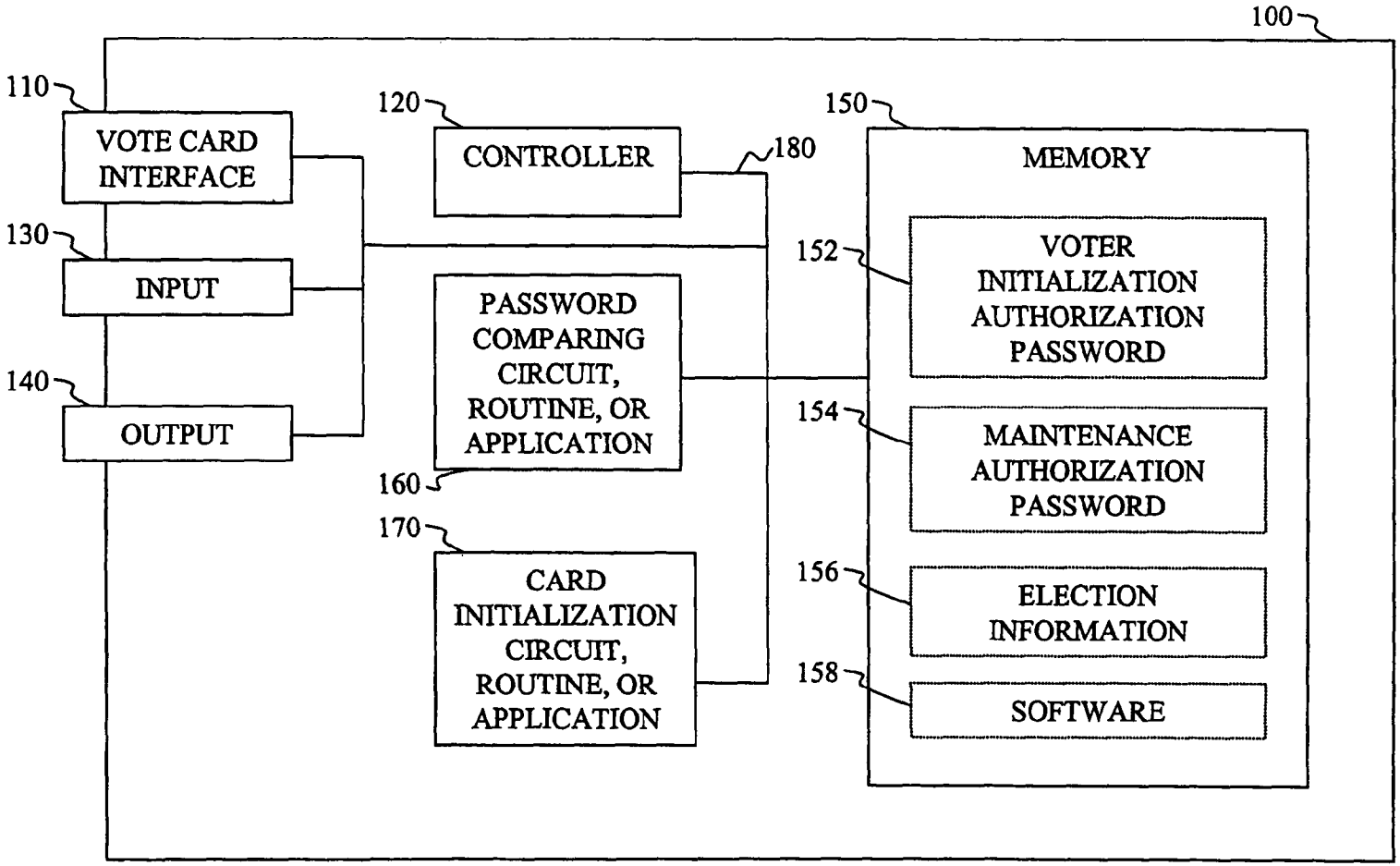
FIG. 1 shows a functional block diagram of an exemplary system for voter information initialization.

FIG. 1 shows a functional block diagram of an exemplary system 100 for voter information initialization before a voter votes. As shown in FIG. 1, the system may physically, functionally, and/or conceptually include, for example, a vote card interface 110, a controller 120, an input 130, and output 140, a memory 150, a password comparing circuit, routine, or application 160 and/or a card initialization circuit, routine, or application 170, each appropriately interconnected by, for example, one or more control and/or data busses and/or application programming interfaces 180.

The vote card interface 110 may be an interface that allows a vote card to be inserted and may allow for data to be read from an/or written onto the vote card. The vote card interface may be, for example, a removable memory interface, such as, for example, a USB interface, a SmartCard® interface, a compact flash interface, a microdrive interface, a non-volatile memory interface, a magnetic card reader/writer, and/or any other now-known or later-developed interface capable of reading and/or writing onto a removable memory.

The controller 120 may be, for example, a CPU and/or MPU, and may also include a RAM and/or ROM. The controller may be, for example, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. The controller 120 may enable the overall control of the system 100.

The input 130 may allow a user to input data into the system and may include, for example, a touch screen, a keyboard, and/or any other now-known or later-developed combination of mechanical and/or electronic components enabling a user to input data into the system 100.

The output 140 may allow information to be output to a user of the system 100, and may include, an LCD display, a CRT display, one or more LEDs, and/or any other now-known or later-developed mechanical or electrical device capable of visually or audibly outputting information to a user of the system 100.

The memory 150 may, for example, store information for use by the system 100 and may include, for example, any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-rewriteable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like.

As shown in FIG. 1, the memory may be physically, functionally, and/or conceptually divided into, for example, a voter initialization authorization password portion 152, a maintenance authorization password portion 154, an election information portion 156, and/or a software portion 158.

The voter initialization authorization password portion 152 may store, for example, a preset voter initialization authorization password allowing a user access to one or more of the voter initialization functions of the system 100. The maintenance authorization password portion 154 may store, for example, a maintenance authorization password allowing a user access to one or more of the voter initialization functions of the system 100. The election information portion 156 may store election information, including, for example, information relating to a particular election for which the system 100 may be used. The software portion 158 may store, for example, software and/or instructions executable by the controller 120 to enable various functions of the system 100.

The password comparing circuit, routine, or application 160, for example, under control of the controller 120, may compare for example a string of characters and/or numbers input on the input 130 with a string of characters and/or numbers stored in either the voter initialization authorization password portion 152 or the maintenance authorization password portion 154. The password comparing circuit, routine, or application 160 may be implemented by, for example, a circuit within an ASIC, or using a FPGA, a PLD, a PLA or a PAL, or using discrete logic elements or discrete circuit elements, and/or may be fully or partially implemented by the controller 120 and/or software stored in the software portion 158.

The card initialization circuit, routine, or application 170, for example, under control of the controller 120, may initialize data on a vote card in the vote card interface 110 by reading and or writing data onto the vote card. The data written onto the vote card may include, for example, unique information identifying the particular voter and/or information permitting access to a voting machine. The card initialization circuit, routine, or application 170 may be implemented by, for example, a circuit within an ASIC, or using a FPGA, a PLD, a PLA or a PAL, or using discrete logic elements or discrete circuit elements, and/or may be fully or partially implemented by the controller 120 and/or software stored in the software portion 158.

Figure 2:
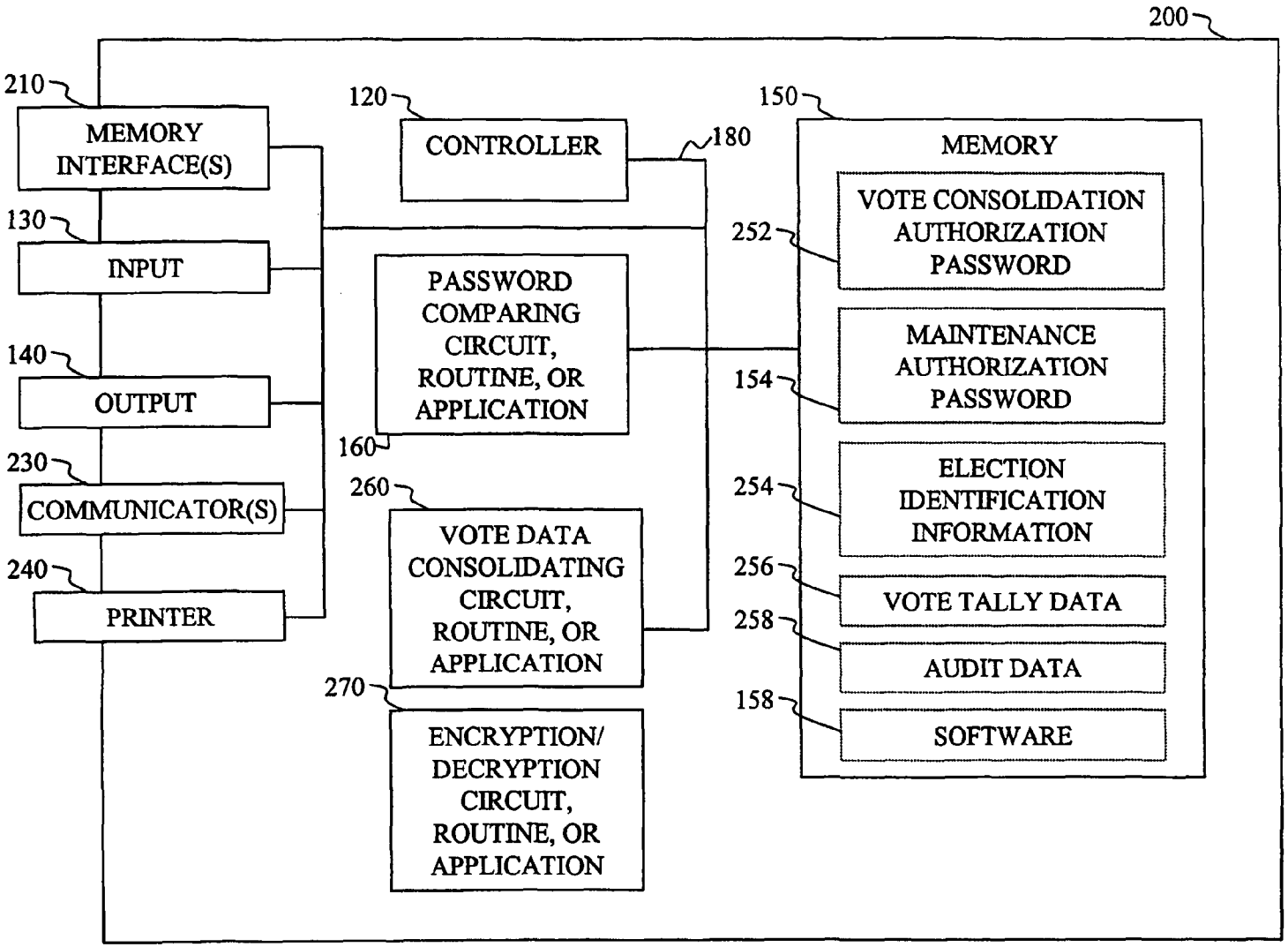
FIG. 2 shows a functional block diagram of an exemplary system for vote data consolidation and/or secure transmission and/or reception of consolidated vote data.

FIG. 2 shows a functional block diagram of an exemplary system 200 for voter information consolidation after voting. Some of the elements of the system 200 may be similar to the elements of system 100 and thus are identified by similar reference numerals. Therefore, a description of the similar elements will be omitted. It should be appreciated, however, that the elements with similar reference numerals in system 200 need not be identical to those described with respect to the system 100, they only need to perform similar functions.

Thus, in addition to one or more of the elements described above, the system 200 may physically, functionally, and/or conceptually include, for example, one or more memory interfaces 210, one or more communicators 230, a printer 240, a vote consolidating circuit, routine, or application 260, and/or an encryption/decryption circuit, routine, or application 270.

The memory interface(s) 210 may be, for example, structure capable of interfacing with a memory outside of the system 200, such as, for example, a memory cartridge of a voting machine. The memory interface(s) 210 may each be configured to interface with a different type of voting machine cartridge or may be configured to each interface with more than one type of voting machine cartridge. Furthermore, one or more of the memory interface(s) 210 may be configured as a receiver that communicates with an external memory over a network, such as, for example, a wired network, a wireless network (e.g., a CDMA 1X network), an intranet, an extranet, and/or the Internet.

The communicator(s) 230 may be, for example, transmitters and/or receivers that allow the system to communicate information. For example, the communicator(s) 230 may be a transmitter that communicates vote tally data consolidated by the system 200 to a central server. The communicator(s) 230 may only be a transmitter and may prevent the receiving of data in order to prevent unauthorized access to the system 200. The communicator(s) may communicate over a network, such as, for example, a telephony network, a wired network, a wireless network (e.g., a CDMA 1X network), an intranet, an extranet, and/or the Internet. The communicator(s) 230 may transmit data (such as vote data and/or passwords) which as been encrypted by an encryption/decryption circuit, routine, or application 270 (described below).

The printer 240 may, for example, allow the system to print data including, for example, vote tally data, audit data, election information, and/or any other information relating to the operation of the system 200. The printer 240 may include, for example, a dot matrix printer, an inkjet printer, a thermal printer, a laser printer, and/or any other now known or later developed device capable of making marks on a substrate.

In addition to, for example, the maintenance authorization password portion 154, and the software portion 158, discussed above, the memory 150 may physically, functionally, and/or conceptually include a vote consolidation authorization password portion 252, an election identification information portion 254, a vote tally data portion 256, and/or an audit data portion 258.

The vote consolidation authorization password portion 252 may, for example, store a preset vote consolidation authorization password allowing a user access to one or more of the vote data consolidation functions of the system 200. The election identification information portion 254 may, for example, store data indicative of a particular election for which the system 200 is consolidating data. For example, the election data may be compared with election data stored on a particular external memory to determine whether vote data on the external memory should be added to the tally data for the particular election. The vote tally data portion 256 may, for example, store a tally of the various vote data that has been input into the system 200 and/or approved by the system 200 for consolidation. The audit data portion 258 may, for example, store audit data. Audit data may be, for example, a record of each successful, unsuccessful, authorized, and/or unauthorized operation requested of, rejected by, and/or performed by the system 200.

The vote consolidating circuit, routine, or application 260, for example, under control of the controller 120, may input data representing one or more votes cast on an electronic voting machine and may alter vote tally data in a manner to reflect the addition of the one or more votes cast to a consolidated total of all votes processed by the system 200. The vote consolidating circuit, routine, or application 260 may be implemented by, for example, a circuit within an ASIC, or using a FPGA, a PLD, a PLA or a PAL, or using discrete logic elements or discrete circuit elements, and/or may be fully or partially implemented by the controller 120 and/or software stored in the software portion 158.

The encryption/decryption circuit, routine, or application 270, for example, under control of the controller 120, may encrypt one or more of the maintenance authorization password, the software, the vote consolidation authorization password, the election identification information portion, the vote tally data, and/or the audit data stored in the memory 150, for secure transmission via the communicator(s) 230. Implementation of this encryption/decryption routine is equally feasible either in an independent circuit, or as part of application software. Said encryption/decryption circuit, routine, or application 270, for example, under control of the controller 120, may also decrypt one or more of a maintenance authorization password, software, a vote consolidation authorization password, election identification information, the vote tally data, and/or audit data, received via the communicator(s) 230 for storage in the memory 150 and/or for consolidation by the vote data consolidating circuit, routine, or application.

Finally, it should be appreciated that the system 200 may also include each element of the system 100. In such a case, the system 200 would be capable of, for example, both voter initialization and vote data consolidation.

Figure 3:
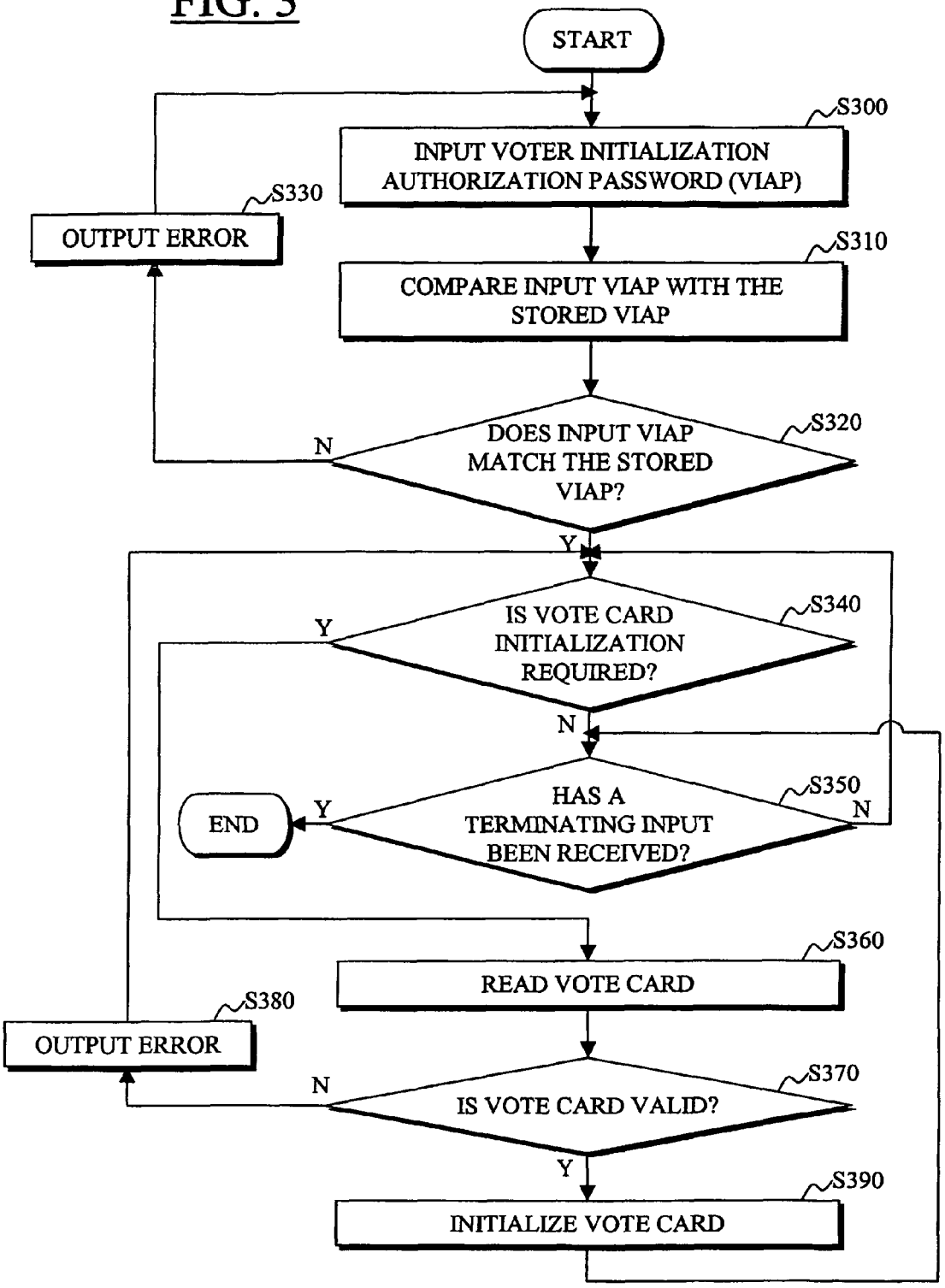
FIG. 3 shows an exemplary method for initializing voter information.

In operation, to perform voter initialization, the systems 100, 200 may be used in conjunction with a method for initializing voter information. FIG. 3 shows an exemplary method for initializing voter information. The exemplary method may be implemented, for example, by one or more components of the above-described system(s). However, even though the exemplary structure of the above-described system(s) may be referenced in the description of the exemplary method, it should be appreciated that the structure is exemplary and the exemplary method need not be limited by any of the above-described exemplary structure.

As shown in FIG. 3, operation of the method begins in step S300 where an optional voter initialization authorization password is input. For example, a user may input a voter initialization authorization password into the input 130, thereby, for example, preparing the system for use during voter initialization. Next, in step S310, the input voter initialization authorization password is compared with stored voter initialization authorization password. For example, under control of the controller 120, the password comparing circuit, routine, or application 160 may compare the input voter initialization authorization password (e.g., stored in the RAM of the controller or a memory portion of the password comparing circuit, routine, or application 160) with the preset voter initialization authorization password stored in the voter initialization authorization password portion 152 of the memory 150. Operation continues to step S320.

In step S320, it is determined whether the input voter initialization authorization password matches the stored voter initialization authorization password. For example, under control of the controller 120, the password comparing circuit, routine, or application 160 may indicate, based on the comparison, whether the input voter initialization authorization password matches the preset voter initialization authorization password. If the passwords do not match (step S320=NO), operation continues to step S330 where an error is output. For example, if the password comparing circuit, routine, or application 160 determined that the passwords do not match, under control of the controller 120, a message may be output on the output 130 indicating that the input password was incorrect and operation returns to step S300. If the passwords match (step S320=YES), operation continues to step S340.

In step S340, it is determined whether a vote card initialization is required. For example, an election official (user) that has successfully entered a voter initialization authorization password may want to initialize a vote card for a voter. Accordingly, the user may insert a vote card into the vote card interface 110. Then, for example, to determine whether initialization is required, the controller 120 may determined whether a vote card has been inserted into the interface 110. If initialization is required (step S340=YES), e.g., a vote card has been entered into the interface 110, operation continues to step S360.

If initialization is not required (step S340=NO), e.g., no vote card has been entered into the interface 110, operation continues to step S350. In step S350, it is determined whether a terminating input has been received. For example, a user may input a command on the input 130 indicating that the voter initialization process is complete, e.g., the election is complete and no more vote cards need to be initialized. Alternatively, a terminating input may be considered to be received when, for example, the system 100 remains idle for a predetermined amount of time. If such a terminating input is received (step S350=YES), operation of the method ends. If such a terminating input is not received, (step S350=NO), operation of the method loops back to step S340.

In step S360, the vote card is read. For example, under control of the controller 120, the vote card is read by the interface 110. Then, in step S370 it is determined whether the card is valid, for example, whether it has been corrupted, tampered with, or is otherwise unsuitable for initialization. If the vote card is not valid (step S370=NO), operation continues to step S380 where an error is output and operation returns to step S340. For, example, under control of the controller 120, a message may be output on the output 130 indicating that the card is invalid. If the vote card is valid (step S370=YES), operation continues to step S390.

In step S390, the vote card is initialized. That is, for example, under control of the controller 120, the initialization circuit, routine, or application 170 may write data onto the vote card that will allow a particular voter to access a voting machine and vote. Operation of the method returns to step S350.

Figure 4:
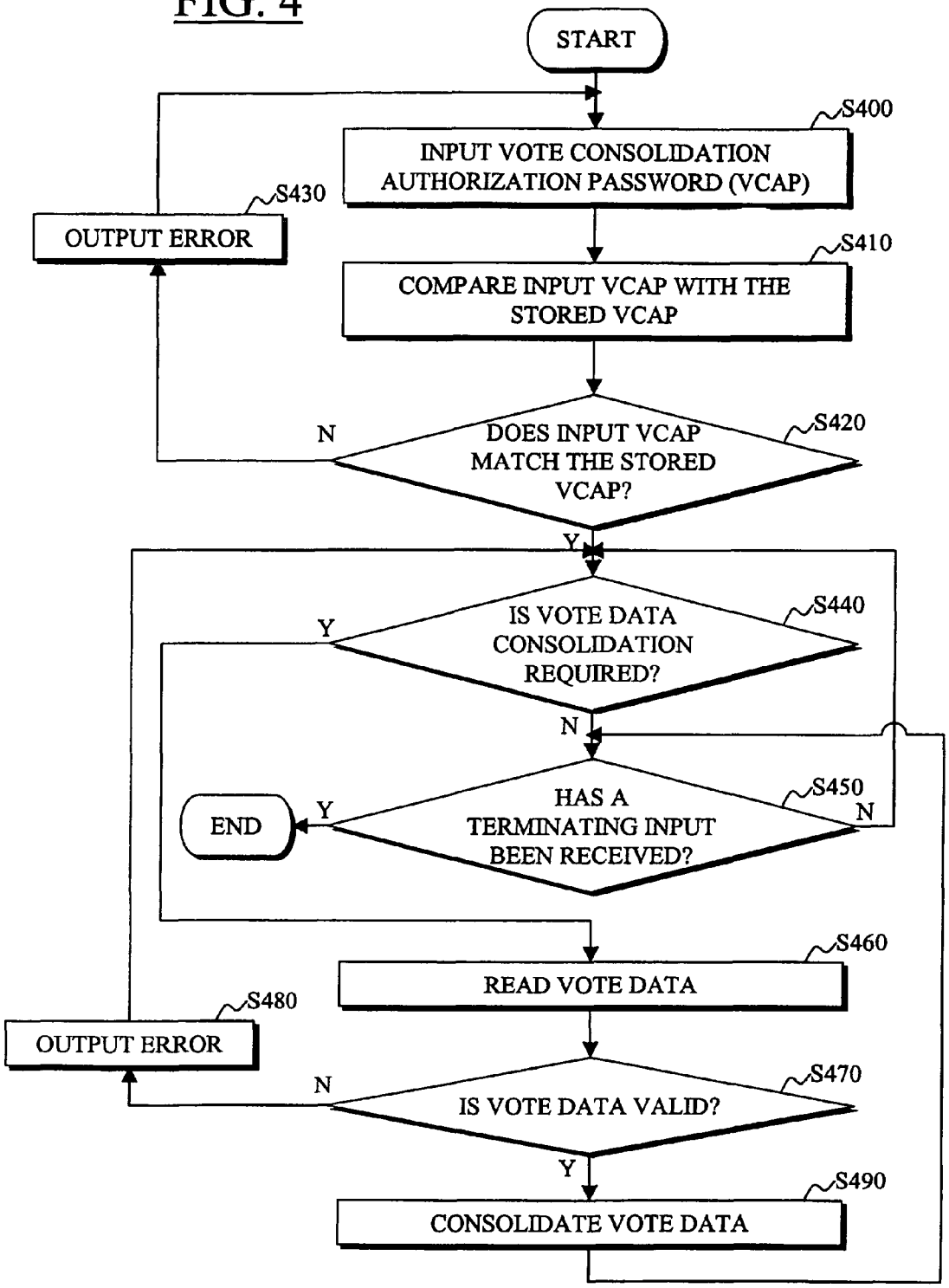
FIG. 4 shows an exemplary method for consolidating vote data.

In operation, to perform vote consolidation, the system 200 may be used in conjunction with a method for initializing voter information. FIG. 4 shows an exemplary method for consolidating voter information. Again, this exemplary method may be implemented, for example, by one or more components of the above-described system(s). However, even though the exemplary structure of the above-described system(s) may be referenced in the description of the exemplary method, it should be appreciated that the structure is exemplary and the exemplary method need not be limited by any of the above-described exemplary structure.

As shown in FIG. 4, operation of the method begins in step S400, where an optional vote consolidation authorization password is input. For example, a user may input a vote consolidation authorization password into the input 130, thereby, for example, preparing the system for use during vote consolidation. For example, during a particular election, according to this exemplary method, the system 200 may be used to consolidate the vote data recorded by a plurality of voting machines at a particular voting location. Also, for example, during a particular election, according to this exemplary method, the system 200 may be used to consolidate the vote data that is to be transmitted to a central vote tabulation headquarters from a plurality of voting locations.

Next, in step S410, the input vote consolidation authorization password is compared with a stored vote consolidation authorization password. For example, under control of the controller 120, the password comparing circuit, routine, or application 160 may compare the input vote consolidation authorization password (e.g., stored in the RAM of the controller or a memory portion of the password comparing circuit, routine, or application 160) with the preset vote consolidation authorization password stored in the vote consolidation authorization password portion 252 of the memory 150. Operation continues to step S420.

In step S420, it is determined whether the input vote consolidation authorization password matches the stored vote consolidation authorization password. For example, under control of the controller 120, the password comparing circuit, routine, or application 160 may indicate, based on the comparison, whether the input vote consolidation authorization password matches the preset vote consolidation authorization password. If the passwords do not match (step S420=NO), operation continues to step S430 where an error is output. For example, if the password comparing circuit, routine, or application 160 determined that the passwords do not match, under control of the controller 120, a message may be output on the output 130 indicating that the input password was incorrect and operation returns to step S400. If the passwords match (step S420=YES), operation continues to step S440.

In step S440, it is determined whether vote consolidation is required. For example, an election official (user) that has successfully entered a vote consolidation authorization password may want to consolidate the votes recorded by a plurality of voting machines and/or consolidate vote data transmitted from a plurality of voting locations. Accordingly, the user may insert a memory (e.g., a memory cartridge) from a voting machine into a memory interface 210. Alternatively, a transmission may be received by communicator(s) 230. Either of these actions, for example, may indicate to the controller 120 that vote data consolidation is required. If vote consolidation is required (step S440=YES), operation continues to step S460.

If vote consolidation is not required (step S440=NO), operation continues to step S450. In step S450, it is determined whether a terminating input has been received. For example, a user may input a command on the input 130 indicating that the vote consolidation process is complete, e.g., all of the data for the election has been consolidated. That is, for example, at a particular polling location, all of the cartridges for each of the voting machines have been consolidated, or at election headquarters, all of the voting data for each polling location has been received and consolidated. If such a terminating input is received (step S450=YES), operation of the method ends. If such a terminating input is not received, (step S450=NO), operation of the method loops back to step S440.

In step S460, vote data is read. For example, under control of the controller 120, vote data from a memory interface 210 may be read from a voting machine's memory or received from a transmission. Because the system 200 may be capable of reading vote data from different types of voting machines, this step may include first recognizing the data structure of the vote data prior to reading the vote data in order to determine the most effective way to read the vote data.

Then, in step S470, it is determined whether the vote data is valid or not, for example, whether it has been corrupted, tampered with, or belongs to a different election, and/or is otherwise unsuitable for consolidation. The validity of the vote data may be determined through various methods, for example, by comparing election information associated with the vote data with election information stored in the election identification information portion 254, by decrypting the data according to a predetermined encryption process, by checking an authorization code associated with the vote data, by determining the origin of the data, by evaluating metadata associated with the vote data, and/or by any other now known or later developed method of determining the validity of electronic data.

In step 470, for example, when a cartridge or other type of memory is inserted into the memory interface 210, the controller 120 may unit first validate that the cartridge/memory structure is the proper structure depending on the type of cartridge/memory. If this structure validation is successful, then the controller 120 may, for example, perform a syntactic validation on a configuration file (e.g., an XML file) contained in the cartridge. The controller 120 may then, for example determine whether election identification information stored on the memory/cartridge data matches the election identification information stored in the election identification information portion 254. After one or more of these validations take place and are successful, the vote data may be considered valid.

If the vote data is not valid (step S470=NO), operation continues to step S480 where an error is output and operation returns to step S440. For, example, under control of the controller 120, a message may be output on the output 140 indicating that the vote data is invalid and will not be added to the vote tally data. If the vote data is valid (step S470=YES), operation continues to step S490.

In step S490, the vote data is added to the vote tally data. That is, for example, under control of the controller 120, the vote data consolidating circuit, routine, or application 260 may read the vote data received from a memory interface 210 and add the vote data to the consolidated vote data stored in the vote tally data portion 256 of the memory 150. Operation of the method returns to step S450.

It should be appreciated that if the system 200 is being used to according to the above described exemplary method to consolidate vote data at a polling location, upon consolidation of the data (e.g., step S450=YES), under control of the controller, the vote tally data may be transmitted by a communicator 230 to a central voting headquarters for further consolidation by another system 200 or any other system or method.

As discussed above, the system 200 may be capable of communicating data via communicator(s) 230 which has been consolidated, and/or which is to be further consolidated at central location. In order to ensure the integrity of such communicated data, the data may be encrypted and/or decrypted by the encryption/decryption circuit, routine, or application 270 prior to being transmitted.

Figure 5:
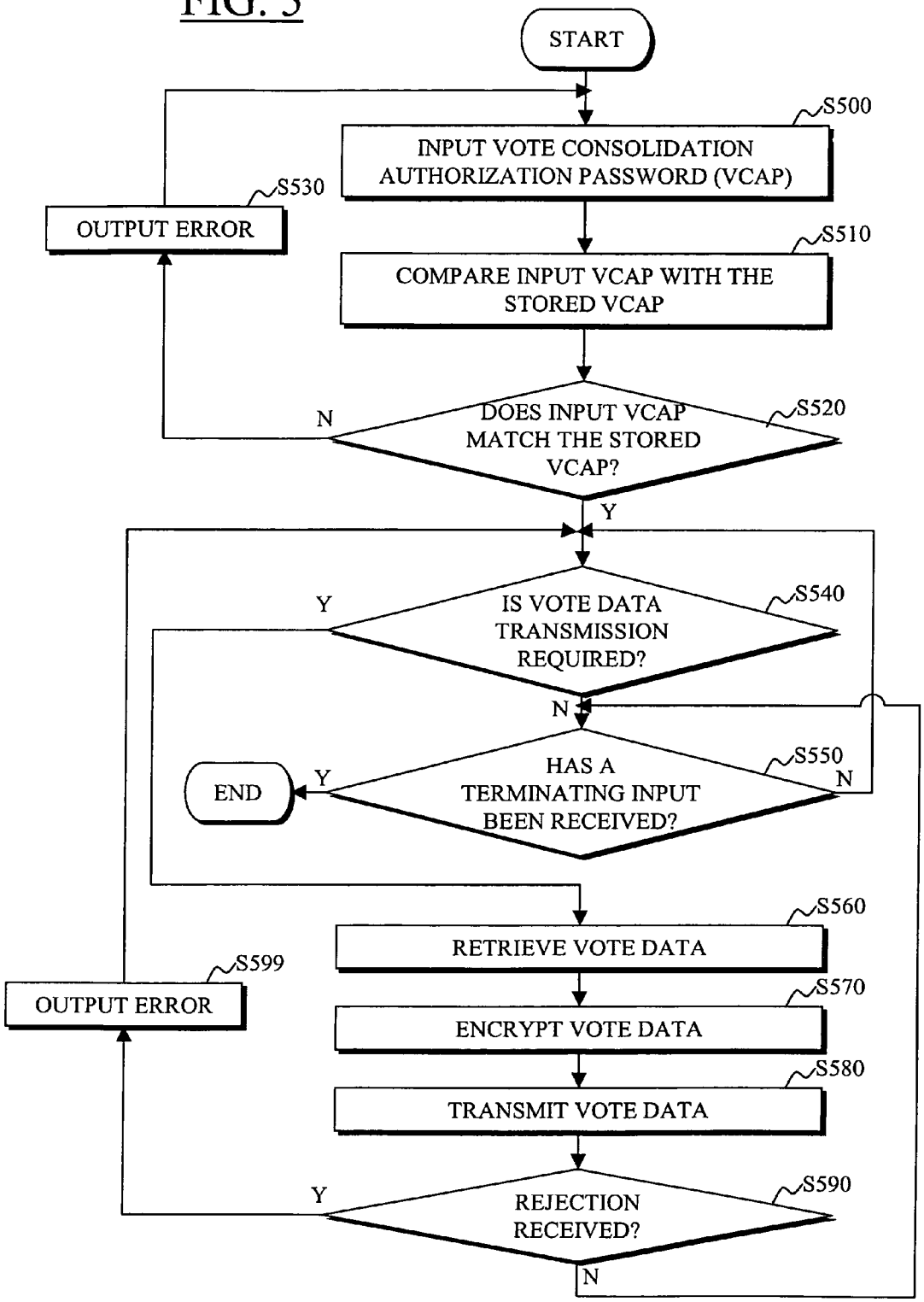
FIG. 5 shows an exemplary method for secure transmission of consolidated vote data.

FIG. 5 shows an exemplary method for transmitting voter information. Again, this exemplary method may be implemented, for example, by one or more components of the above-described system(s). However, even though the exemplary structure of the above-described system(s) may be referenced in the description of the exemplary method, it should be appreciated that the structure is exemplary and the exemplary method need not be limited by any of the above-described exemplary structure.

As shown in FIG. 5, operation of the method begins in step S500, where an optional vote consolidation authorization password is input. For example, a user may input a vote consolidation authorization password into the input 130, thereby, for example, preparing the system for use during consolidated vote data transmission. It should be appreciated that a password different than the vote consolidation authorization password may also be used.

The description of steps S510-S530 is identical to steps S410-S430. Accordingly, a description thereof is omitted. Furthermore, if the vote consolidation authorization password is used, and has been previously entered by a poll worker in order to consolidate vote data (e.g., in step S400), operation of this method may omit steps S510-S530 and may begin at step S540.

In step S540, it is determined whether vote data transmission is required. For example, at the close of voting and after consolidation of the vote data at a polling location, an election official (user) may want to transmit the consolidated vote data to a central location for further consolidation. Accordingly, if consolidated vote data transmission is required (step S540=YES), operation continues to step S560.

If consolidated vote data transmission is not required (step S540=NO), operation continues to step S550. In step S550, it is determined whether a terminating input has been received. For example, a user may input a command on the input 130 indicating that the consolidated vote data transmission is complete, e.g., all of the consolidated vote data for the particular polling location has been successfully transmitted. That is, for example, at a particular polling location, all of the consolidated vote data been successfully transmitted. If such a terminating input is received (step S550=YES), operation of the method ends. If such a terminating input is not received, (step S550=NO), operation of the method loops back to step S540.

In step S560, the consolidated vote data is retrieved. For example, under control of the controller 120, the consolidated vote data is retrieved from the vote tally data portion 256. That is, all of the data consolidated by the system (e.g., according the exemplary method of FIG. 4) may be retrieved from the vote tally data portion 256 in preparation for transmission to a central location. Furthermore, in addition to (or instead of) the consolidated vote data, the audit data may also be retrieved for transmission to the central location. A data package to be transmitted may include a generated hash file and a data file, for instance an XML file. The hash file may be used to ensure that transmitted package has not been tampered with. The XML file may include, for example, an ID of the system 200, the consolidated vote data, and/or an audit log.

Then, in step S570, the data package data is encrypted, for example, to insure its integrity during transmission to the central location. For example, under control of the controller 120, the retrieved consolidated vote data may be encrypted by the encryption/decryption circuit, routine, or application 270. The encryption algorithm used may be, for example, Rijndael. Rijndael is a symmetric key cipher that operates on fixed-length groups of bits, termed blocks, with an unvarying transformation, adopted as an encryption standard by the US government. However, any other now known or later developed encryption method may be used to encrypt the data package.

In step 580, the data package, including the consolidated vote data is transmitted. The data package may be transmitted, for example, through a CDMA 1X network using a secure transmission protocol known as Secure HTTP (S-HTTP). S-HTTP is designed to transmit individual messages securely and has been approved by the Internet Engineering Task Force (IETF) as a standard. However, any other now known or later developed secure transmission method may be used to transmit the data package.

In step S590, it is determined whether a rejection is received. For example, if the data package is received by the central location and rejected by the central location, a message indicating the rejection may be sent back to the system 200. For example, as discussed below with respect to FIG. 6, the central location may receive the package through a network and attempt to validate the ID of the system 200, which is also stored in the central location's database. If there is a match, the central location may proceed to decrypt the package with the hash and produce another hash from the received package. The central location may then compare the two hashes. If the two hashes match, there is a high probability that the package was transmitted intact. Then, the central location may perform a syntactic validation of the XML file and extract the consolidated vote data, and/or an audit log. Importantly, if any of these steps fail, the received data may be considered corrupt and a rejection may be sent to the system 200.

If a rejection is received, indicating that the data package was rejected by the central location (step S590=YES), operation continues to step S599 where an error is output and operation returns to step S540. For, example, under control of the controller 120, a message may be output on the output 140 indicating that the transmitted consolidated vote data was rejected by the central location. If no rejection is received (step S590=YES), operation returns to step S540.

In step S590, the vote data is added to the vote tally data. That is, for example, under control of the controller 120, the vote data consolidating circuit, routine, or application 170 may read the vote data received from a memory interface 210 and add the vote data to the consolidated vote data stored in the vote tally data portion 256 of the memory 150. Operation of the method returns to step S540.

As discussed above, the system 200 may be capable of receiving vote data via communicator(s) 230 for consolidation, or for further consolidation, at a central location. As discussed above, in order to ensure the integrity of such communicated data, the data may be encrypted and/or decrypted by the encryption/decryption circuit, routine, or application 270 prior to being transmitted.

Figure 6:
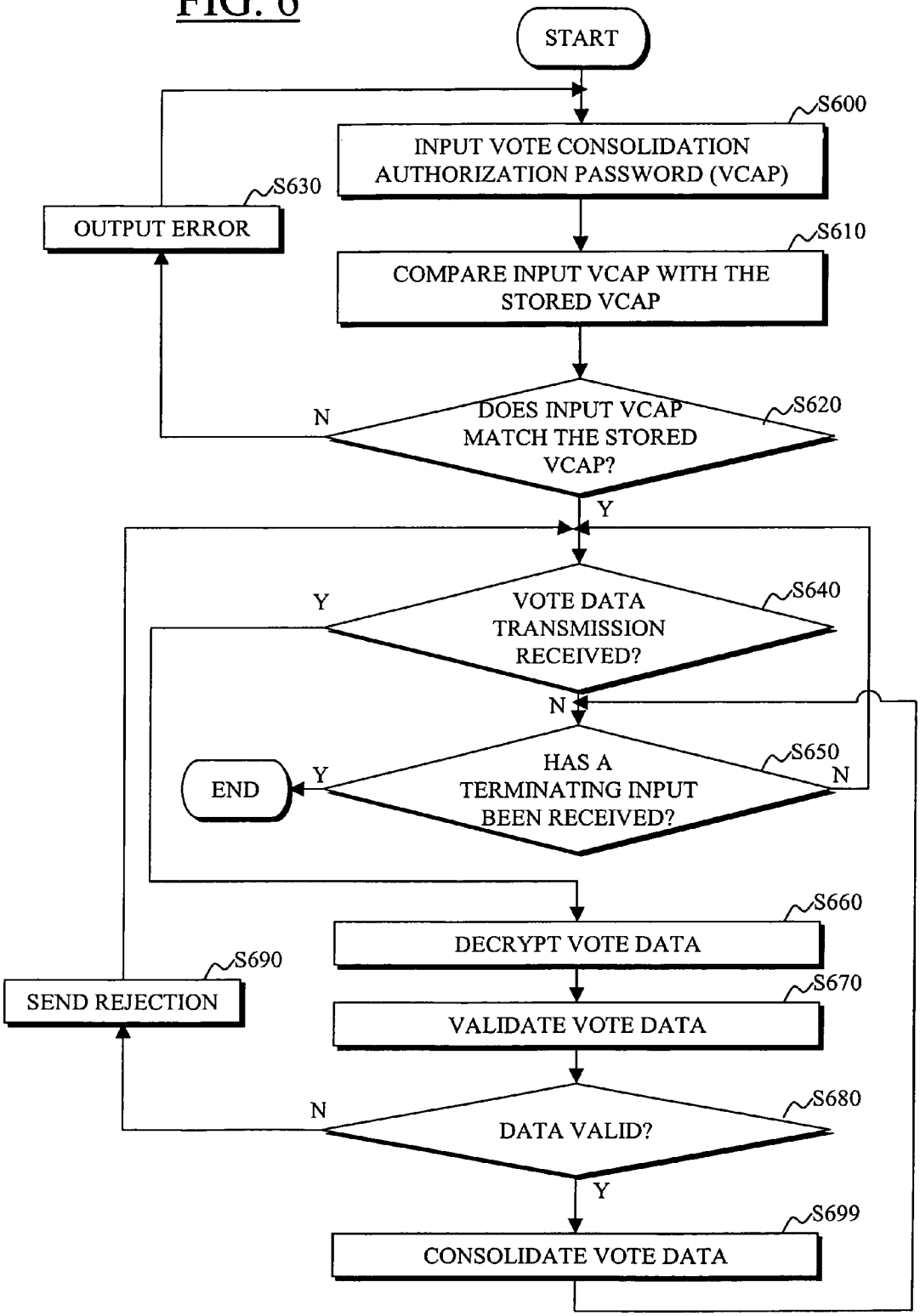
FIG. 6 shows an exemplary method for secure reception of consolidated vote data.

FIG. 6 shows an exemplary method for receiving voter information. Again, this exemplary method may be implemented, for example, by one or more components of the above-described system(s). However, even though the exemplary structure of the above-described system(s) may be referenced in the description of the exemplary method, it should be appreciated that the structure is exemplary and the exemplary method need not be limited by any of the above-described exemplary structure.

As shown in FIG. 6, operation of the method begins in step S600, where a vote consolidation authorization password is input. For example, a user may input a vote consolidation authorization password into the input 130, thereby, for example, preparing the system for use during consolidated vote data transmission. It should be appreciated that a password different than the vote consolidation authorization password may also be used.

The description of steps S610-S630 is identical to steps S410-S430. Accordingly, a description thereof is omitted. Furthermore, if the vote consolidation authorization password is used, and has been previously entered by a poll worker in order to consolidate vote data (e.g., in step S400), operation of this method may omit steps S610-S630 and may begin at step S640.

In step S640, it is determined whether a vote data transmission has been received. For example, at the close of voting and after consolidation of the vote data at a polling location, an election official (user) may have transmitted consolidated vote data from a polling location to the central location for further consolidation by system 200. As discussed above, the data package may be transmitted, for example, through a CDMA 1X network using S-HTTP, or by other methods.

If vote data has not been received (step S640=NO), operation continues to step S650. In step S650, it is determined whether a terminating input has been received. For example, a user may input a command on the input 130 indicating that the reception and consolidation of vote data is complete, e.g., all of the consolidated vote data for the particular polling location has been successfully transmitted to and received by the system 200 and then further consolidated by the system. If such a terminating input is received (step S650=YES), operation of the method ends. If such a terminating input is not received, (step S650=NO), operation of the method loops back to step S640. If vote data has been received (step S640=YES), operation continues to step S660.

In step S660, the received vote data is at least partially decrypted. For example, under control of the controller 120, the received vote data may be input to the encryption/decryption circuit, routine, or application 270 from the communicator(s) 230. Then under control of the controller 120, the encryption/decryption circuit, routine, or application 270 may decrypt the received data. For example, as discussed above, the decryption algorithm used to decrypt the encrypted data will correspond to the encryption algorithm used to encrypt the data may be, for example, Rijndael or another decryption algorithm.

Then, in step S670, the decrypted vote data is validated, for example, to insure its integrity during transmission to the central location. As discussed above, the received data package may include a generated hash file and an XML file. The hash file may be used to ensure that transmitted package has not been tampered with. The XML file may include, for example, an ID of the system 200, the consolidated vote data, and/or an audit log.

During validation, the controller 120 may compare the sending system ID with, for example, pre-approved sending system IDs stored in the election identification information portion 254. If the sending system ID matched a stored ID, the controller 120 may then control the encryption/decryption circuit, routine, or application 270 to decrypt a remainder of the encrypted data if it was not fully decrypted. Then, continuing validation, the controller 120 may produce its own hash based on the received package. The controller may then compare the produced hash with the hash included in the data package. If the two hashes match, there is a high probability that the package was transmitted intact. Finally, the controller 120 may perform a syntactic validation of the XML file contained in the data package. Importantly, if any of these validation steps fail, the received data may be considered corrupt.

In step S680, it is determined if the received data is valid. That is based on the validation if the data is corrupt (step S680=NO), operation continues to step S690 where a rejection is sent back to the system 200 that sent the data. If the data is not corrupt (step S680=YES), operation continues to step S699.

In step S699, the decrypted and validated data is consolidated (e.g., according to the method of FIG. 4) That is, for example, under control of the controller 120, the vote data consolidating circuit, routine, or application 170 may read decrypted vote data and add the vote data to the consolidated vote data stored in the vote tally data portion 256 of the memory 150. Operation of the method returns to step S650.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

According to one or more of the above examples, it is possible to securely compile vote data from electronic voting machines at a polling location and securely transmit the vote data to a central location for tabulation. This may be done using a same system 200 at the polling location and the central location.

According to one or more of the above examples, vote data can be collected and consolidated from a plurality of types or generations of voting machines.

According to one or more of the above examples, vote data can be transmitted from other locations having a plurality of voting machines each. After such vote data has been consolidated, it may be further transmitted to the consolidated vote data to a central tabulation headquarters.

According to one or more of the above examples, after establishing a voter's identity, a voter authorization card may be initialized for the voter. After the authorization card is initialized, the voter may use the card to gain access to a voting machine.

One or more of the above examples, provide enhanced security by implementing systems, methods, and programs that manage a password-based authorization mechanism. Such security mechanism would operate at the voter initialization and at the vote consolidation levels. In each case, an input password is compared with the stored authorization password, and if the input password equals the stored password, the result will be that the intended function will be allowed: either a voter card that uniquely identifies a corresponding voter will be initialized, the voter card subsequently allowing access to a voting machine; or a data structure of the input vote data will be recognized, and based on the data structure of the vote data, the vote count data from the input vote data will be extracted, and the vote count data will be added to the vote tally data.

What is claimed is:

1. A system for vote information consolidation, comprising:

a memory interface for inputting a physical portable memory device from each of a plurality of voting machines into the system, each memory device containing vote data for a corresponding one of the voting machines and which represents the votes of a plurality of voters that voted using the corresponding voting machine;

a memory storing vote tally data;

a transmitter for securely transmitting the vote tally data; and a controller that:

for the vote data for each of the plurality of voting machines:

recognizes a data structure of the input vote data from among a plurality of vote data structures;

once the data structure has been recognized, decrypts the input vote data;

validates the vote data by comparing the vote data to prestored validation information to ensure that the vote data is authentic; and based on the data structure of the vote data, extracts vote count data from the input vote data and adds the vote count data to the vote tally data; and causes the transmitter to securely transmit the vote tally data to a central tally server for tabulation.

2. The system of claim 1, wherein:

the memory stores a vote consolidation authorization password; and the controller compares an input vote consolidation password with the stored vote consolidation authorization password; and if the input vote consolidation password does not equal the stored vote consolidation authorization password, the controller does not extract the vote count data from the input vote data.

3. The system of claim 1, wherein:

the memory stores election identification data; and for the vote data for each voting machine:

the controller reads election identification information from the input vote data; and if the read election identification information does not match the stored election identification information, the controller prevents the reading of the vote count data.

4. The system of claim 1, wherein the transmitter is not permitted to receive any data from sources outside the system.

5. The system of claim 1, wherein the transmitter transmits vote tally integrity data with the vote tally data, the vote tally integrity data usable by the central tally server to determine the integrity of the vote tally data.

6. The system of claim 5, wherein the vote tally integrity data comprises a hash file.

7. The system of claim 1, wherein the controller encrypts the vote tally data prior to the vote tally data being transmitted.

8. The system of claim 7, wherein the vote tally data is encrypted according to a Rijndael encryption algorithm.

9. The system of claim 1, wherein the transmitter securely transmits the vote tally data to the central tally server across a CDMA 1X network.

10. The system of claim 1, wherein the transmitter securely transmits the vote tally data to the central tally server using S-HTTP.

11. The system of claim 1, wherein:

the memory stores audit data, the audit data comprising a log of the successful functions performed by the system and the unsuccessful operations attempted by the system or requested of the system; and the audit data is securely transmitted to the central tally server with the vote tally data.

12. The system of claim 1, further comprising a system for voter information initialization, wherein:

the memory stores a voter initialization authorization password; and the controller compares an input voter initialization password with the stored a voter initialization authorization password; and if the input voter initialization password equals the stored a voter initialization authorization password, the controller initializes a voter card that uniquely identifies a corresponding voter, the voter card allowing access to a voting machine.

13. The system of claim 1, wherein:

the memory stores a maintenance authorization password;

the controller compares an input maintenance password with the stored maintenance authorization password; and if the input maintenance password equals the stored maintenance authorization password, the controller permits at least one of:

setting the date and time;

preparing the system for use during a particular election;

upgrading stored software;

resetting the system to a default maintenance configuration; and testing the unit.

14. The system of claim 1, further comprising a printer that prints at least one of:

the vote count data;

the tally data; and audit data.

15. The system of claim 1, further comprising a receiver for receiving secure transmissions, wherein the controller:

extracts vote data from a received secure transmission;

recognizes a data structure of the extracted vote data;

based on the data structure of the extracted vote data, extracts vote count data from the received vote data and adds the vote count data to the vote tally data.

16. The system of claim 15, wherein the extracted vote data is previously consolidated vote data for further consolidation.

17. The system of claim 15, wherein the controller extracts vote tally integrity data with the vote tally data, the vote tally integrity data usable by the controller to determine the integrity of the extracted vote data.

18. The system of claim 17, wherein the vote tally integrity data comprises a hash file.

19. The system of claim 15, wherein the controller decrypts the extracted vote tally data.

20. The system of claim 19, wherein the vote tally data is decrypted according to a Rijndael encryption algorithm.

21. The system of claim 15, wherein the receiver receives the secure transmission across a CDMA 1X network.

22. The system of claim 15, wherein the receiver receives the secure transmission using S-HTTP.

23. A method for vote information consolidation, comprising:

inputting a physical portable memory device from each of a plurality of voting machines into a memory interface of the system, each memory device containing vote data for a corresponding one of the voting machines and which represents the votes of a plurality of voters that voted using the corresponding voting machine;

storing vote tally data;

for the vote data for each of the plurality of voting machines:

recognizing a data structure of the input vote data from among a plurality of vote data structures;

once the data structure has been recognized, decrypting the input vote data;

validating the vote data by comparing the vote data to prestored validation information to ensure that the vote data is authentic; and extracting, based on the data structure of the vote data, vote count data from the input vote data and adding the vote count data to the vote tally data; and causing a transmitter to securely transmit the vote tally data to a central tally server for tabulation.

24. The method of claim 23, further comprising:

storing a vote consolidation authorization password; and comparing an input vote consolidation password with the stored vote consolidation authorization password; and not extracting, if the input vote consolidation password does not equal the stored vote consolidation authorization password, the vote count data from the input vote data.

25. The method of claim 23, further comprising:

storing election identification data; and for the vote data for each voting machine:

reading election identification information from the input vote data; and preventing, if the read election identification information does not match the stored election identification information, the reading of the vote count data.

26. The method of claim 23, further comprising preventing the reception of any data from sources outside the system.

27. The method of claim 23, further comprising transmitting vote tally integrity data with the vote tally data, the vote tally integrity data usable by the central tally server to determine the integrity of the vote tally data.

28. The method of claim 27, wherein the vote tally integrity data comprises a hash file.

29. The method of claim 23, further comprising encrypting the vote tally data prior to the vote tally data being transmitted.

30. The method of claim 29, wherein the vote tally data is encrypted according to a Rijndael encryption algorithm.

31. The method of claim 23, further comprising securely transmitting the vote tally data to the central tally server across a CDMA 1X network.

32. The method of claim 23, further comprising securely transmitting the vote tally data to the central tally server using S-HTTP.

33. The method of claim 23, further comprising:

storing audit data, the audit data comprising a log of the successful functions performed by the system and the unsuccessful operations attempted by the system or requested of the system; and securely transmitting the audit data to the central tally server with the vote tally data.

34. The method of claim 23, further comprising:

storing a voter initialization authorization password; and comparing an input voter initialization password with the stored a voter initialization authorization password; and initializing, if the input voter initialization password equals the stored a voter initialization authorization password, a voter card that uniquely identifies a corresponding voter, the voter card allowing access to a voting machine.

35. The method of claim 23, further comprising:

storing a maintenance authorization password;

comparing an input maintenance password with the stored maintenance authorization password; and if the input maintenance password equals the stored maintenance authorization password, permitting at least one of:

setting the date and time;

preparing the system for use during a particular election;

upgrading stored software;

resetting the system to a default maintenance configuration; and testing the unit.

36. The method of claim 23, further comprising printing at least one of:

the vote count data;

the tally data; and audit data.

37. The method of claim 23, further comprising:

receiving a secure transmission;

extracting vote data from the received secure transmission;

recognizing a data structure of the extracted vote data;

extracting, based on the data structure of the extracted vote data, vote count data from the received vote data and adds the vote count data to the vote tally data.

38. The method of claim 37, wherein the extracted vote data is previously consolidated vote data for further consolidation.

39. The method of claim 37, further comprising extracting vote tally integrity data with the vote tally data, the vote tally integrity data usable to determine the integrity of the received vote data.

40. The method of claim 39, wherein the vote tally integrity data comprises a hash file.

41. The method of claim 37, further comprising decrypting the extracted vote tally data.

42. The method of claim 41, wherein the vote tally data is decrypted according to a Rijndael encryption algorithm.

43. The method of claim 37, further comprising receiving the secure transmission data across a CDMA 1x network.

44. The method of claim 37, further comprising receiving the secure transmission data using S-HTTP.

45. A non-transitory computer-readable storage medium storing a computer-executable vote consolidation program, the program comprising:

instructions for reading vote data from a physical portable memory device of each of a plurality of voting machines when each memory device is inserted in to a memory interface, the vote data including vote data from a corresponding one of the voting machines, the vote data for each voting machine representing the votes of a plurality of voters that voted using the voting machine;

instructions for storing vote tally data;

instructions for, for the vote data for each of the plurality of voting machines:

recognizing a data structure of the vote data from among a plurality of vote data structures;

once the data structure has been recognized, decrypting the read vote data;

validating the vote data by comparing the vote data to prestored validation information to ensure that the vote data is authentic;

extracting, based on the data structure of the vote data, vote count data from the input vote data and adding the vote count data to the vote tally data; and instructions for causing the transmitter to securely transmit the vote tally data to a central tally server for tabulation.

* * * * *